United States Patent [19]

Boyd et al.

[11] Patent Number: 4,617,008

[45] Date of Patent: Oct. 14, 1986

[54] METHOD AND APPARATUS FOR FORMING HEMS IN SUPERPOSED PLIABLE PANELS

[75] Inventors: Dana M. Boyd, Rushville; Franz Bustin, Rochester, both of N.Y.

[73] Assignee: Mobil Oil Corporation, New York, N.Y.

[21] Appl. No.: 652,255

[22] Filed: Sep. 20, 1984

[51] Int. Cl.[4] ..... B31B 1/36

[52] U.S. Cl. ..... 493/248; 493/243; 493/440

[58] Field of Search ..... 493/225, 928, 194, 196, 493/199, 213, 231, 239, 243, 248, 246, 357, 362, 369, 381, 255, 439, 440, 446, 447, 456, 461; 112/141, 147, 152, 137, 121.26, 121.27

[56] References Cited

U.S. PATENT DOCUMENTS

| | | | |
|---|---|---|---|
| 245,615 | 8/1881 | Ferriss | 112/141 |
| 2,213,157 | 8/1940 | Brenn | 270/52 |
| 2,798,523 | 7/1957 | Barrett | 150/11 |
| 2,897,729 | 8/1959 | Ashton et al. | 493/225 |
| 2,951,459 | 9/1960 | Judelson | 112/203 |
| 3,043,532 | 4/1962 | Seiden | 242/57.1 |
| 3,058,402 | 10/1962 | Kugler | 493/196 |
| 3,196,757 | 7/1965 | Samways | 493/214 |
| 3,656,415 | 4/1972 | Hook, Jr. | 493/196 |
| 3,687,357 | 8/1972 | Hansen | 229/63 |
| 3,720,141 | 3/1973 | Stock | 493/194 |
| 3,737,091 | 6/1973 | Barta et al. | 226/193 |
| 3,758,364 | 9/1973 | Edelman | 156/463 |
| 3,772,948 | 11/1973 | Burton | 83/23 |
| 3,954,049 | 5/1976 | Drieske | 493/188 |
| 4,138,932 | 2/1979 | Mowli | 493/195 |
| 4,187,968 | 2/1980 | Winterholler et al. | 226/92 |
| 4,385,716 | 5/1983 | DeRoeck et al. | 226/18 |
| 4,430,845 | 2/1984 | Dohrendorf | 493/440 |

*Primary Examiner*—Lowell A. Larson
*Assistant Examiner*—Robert Showalter
*Attorney, Agent, or Firm*—Alexander J. McKillop; Michael G. Gilman; Charles J. Speciale

[57] ABSTRACT

An improved former and method of forming superposed hems in superposed panels forming a continuous pliable and foldable web, especially thin plastifilm panels for forming plastic bags includes a first turning edge for turning at least an intermediate portion of the superposed panels from a first direction to a second direction, a second turning edge adjoining one side of the first turning edge for turning superposed free side edge portions of the web transverse to the intermediate portions and third and fourth turning edges spanning both the turned intermediate portions and turned side edge portions of the web for turning a separate one of the side edge portions against the turned intermediate portion thereby forming the hem.

17 Claims, 8 Drawing Figures

FIG. 5
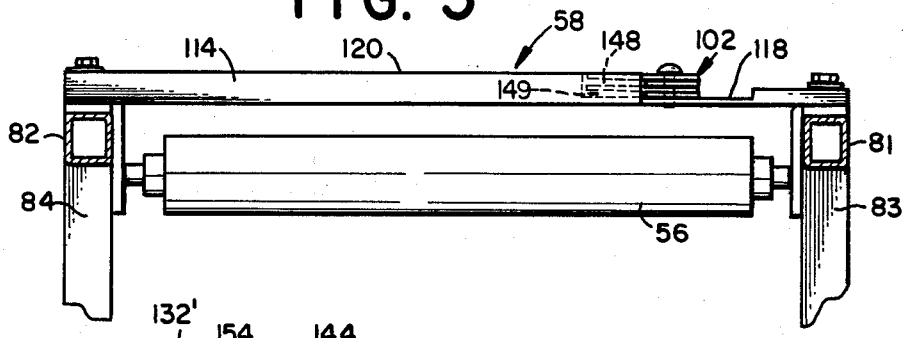
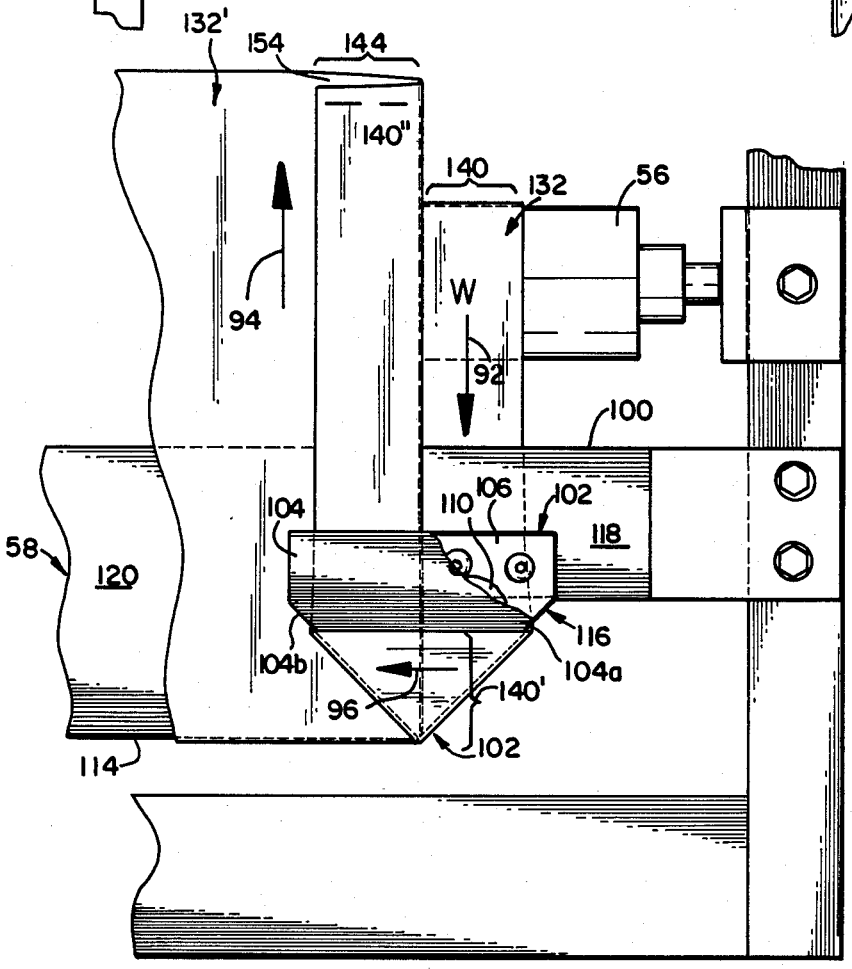
FIG. 6

METHOD AND APPARATUS FOR FORMING HEMS IN SUPERPOSED PLIABLE PANELS

FIELD OF THE INVENTION

This invention relates to the forming of hems (i.e., turned edges) in superposed panels of pliable materials such as thermoplastic films and fabrics and, in particular, to apparatus for and method of forming hems by turned superposed, longitudinal edge portions of a pair of superposed panels of indeterminate length inwardly between the panels in the manufacture of draw tape or draw string plastic bags.

BACKGROUND OF THE INVENTION

In the manufacture of draw tape and draw string plastifilm bags, a tunnel structure containing the draw string(s) or draw strip(s) is provided around the mouth of the bag by hemming or turning edge portions of two panels forming the bag. A number of methods and apparatus have been employed in the past to provide these hems. Two examples of the prior methods and apparatus are provided by U.S. Pat. Nos. 2,897,729 to Ashton et al and 3,058,402 to Kugler. In Ashton, two superposed panels of a medianly folded plastifilm sheet are each outwardly hemmed by devices not depicted or described. While outward hemming of a pair of superposed panels is rapidly and easily accomplished, it provides an exposed hem on the outside of the bag which is not aesthetically pleasing. Kugler depicts the previously employed method of forming an inwardly hemmed bag: laying down draw tapes or draw strings on the same side of a flat, plastifilm sheet near the longitudinal side edges of the sheet; turning those longitudinal edges over the strips or strings and towards one another, and medianly folding the sheet once again in the same direction to place the inwardly turned edge portions between the panel portions. The drawback to this method is that the full width of a flat plastic sheet must be used in the early portion of the manufacture. Since the plastifilms involved are typically blown tube extruded, extra manufacturing steps are required to provide a fully flattened, single layer sheet. Moreover, considerable floor space is required in the manufacturing areas to provide sufficient room to work with the fully opened sheet.

A number of other patents describe or refer to the forming of one or more folds in thermoplastic film while forming plastic bag bodies or wrappers. U.S. Pat. No. 4,430,845 depicts a folder for polyfilms, utilizing large and small folding triangles on opposite sides of a folding board to turn in, first one and then the other free longitudinal edge of a flat, continuous, polyfilm sheet during the packaging of articles. U.S. Pat. Nos. 3,656,415, 3,954,049 and 4,138,932 depict and/or describe turning over one or both free edges of a flat, continuous, polyfilm sheet during the formation of bag bodies. None of these devices is suitable for providing a pair of inwardly turned hems in superposed plastifilm panels.

Another U.S. Pat. No. 3,720,141 relating to the manufacture of plastic carrier bags includes a "lip folding 5 apparatus 30" formed by sets of creasing rolls **32*a*–32*d*** and related devices neither depicted nor described. The apparatus is described as being capable of turning adjoining, free longitudinal edges of the superposed panels of a medianly folded thermoplastic film inward once or twice, if desired, to form a pair of hems along one longitudinal edge of the film. The use of moving parts needed for this apparatus adds to its cost of manufacture and the number of rollers involved (at least four) and required other devices add further to the cost of manufacture and take up more than an insignificant area in the manufacturing line.

SUMMARY OF THE INVENTION

It is an object to provide a novel former for pliable, oldable materials.

It is another object of the present invention to provide method and apparatus for inwardly hemming a pair of adjoining pliable material panels.

It is yet another object of the invention to inwardly hem superposed panels of a folded sheet of plastifilm for the manufacture of plastifilm bags.

It is another object of the invention to provide a method and apparatus for forming inwardly turned hems in superposed pliable material panels either as the panels are continuously advanced or while they are intermittently advanced.

It is yet another object of the invention to provide an inexpensive apparatus of simple mechanical instruction and with no moving parts to inwardly hem superposed panels.

It is another object of the invention to provide an extremely compact and mechanical apparatus for inwardly hemming superposed pliable material panels.

It is yet another object of the invention to provide a method and apparatus for simultaneously inwardly hemming the longitudinal edges of a pair of superposed pliable material panels.

It is yet another object of the invention to provide inwardly turned hems in pairs of superposed pliable material panels by the use of triangular arranged turning surfaces.

A former, according to the subject invention, is provided for positioning between a means feeding a pair of superposed, pliable material panels and means taking up the fed panels under tension, and includes a main turning edge for turning all but a side edge portion of the juxtaposed panels from a first, fed direction to a second, taken-up direction, a second hemming edge extending from one side of the first edge across the side edge portions of the juxtaposed layers, forming a plane with the main edge in which said second direction lies to turn said side edge portion of the juxtaposed layers substantially transverse to said second direction and towards the turned remaining portion of the panels, and third and fourth edges lying within planes substantially parallel with the plane formed by the first and second edges and an axis extending from the junction of the first and second edges at an included angle of less than 90° to the first edge and an included angle of 90° or less with respect to the second edge between the remaining turned portions of the panels separating those panels and edge turning a separate one of the side edge portions of the panels passing between the third and fourth edges against the remaining, turned portion of the same panel for turning each of the remaining side edge portions of either panel in said second direction.

According to the described, preferred embodiment of the invention, the fed web is substantially reversed in direction over the main turning edge, the second hemming edge forms an approximately 135° included angle with the main turning edge and the third and fourth turing edges each forms a 90° included angle with the second hemming edge and 45° included angle with the main turning edge.

According to yet another important aspect of the invention, the preferred embodiment of the apparatus is formed by a main plate assembly and a removable triangular turning assembly. The triangular turning assembly comprises a pair of space plates providing said third and fourth turning edges.

According to yet another important aspect of the preferred embodiment of the invention, the direction of the superposed panels is reversed over the main turning edge of the plate and the third and fourth turning edges each forms one isosceles right triangle leg of a separate triangular turning plate of the turning assembly.

These and other objects and advantages of the invention will become apparent to those skilled in the art from the following detailed description of a preferred embodiment and from the accompanying figures.

DETAILED DESCRIPTION OF THE DRAWINGS

FIG. 5 is a front view of the forward or turning edge of the device of FIG. 2;

FIG. 6 depicts in a partially section view the hemming of the inner panel of the web;

DETAILED DESCRIPTION OF THE INVENTION

Figure 1:
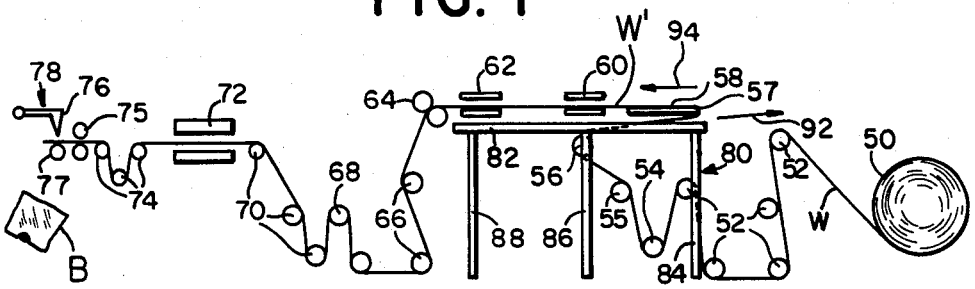
FIG. 1 is a diagrammatic side view of a draw tape thermofilm plastic bag manufacturing line including the hemmer of the subject invention.

FIG. 1 depicts, very diagrammatically, a draw tape bag manufacturing line incorporating the subject invention. A centrally longitudinally folded continuous sheet of thermoplastic film W is fed from a roll 50 over idler rollers 52, through a dancer roller 54 moveable in the vertical direction and controlling a brake on the roll 50, additional idler rollers 55 and 56, across the forward turning edge 57 of the hem forming apparatus 58 of the subject invention, through a punch 60 and draw tape inserter 62 by nip rollers 64 which maintain the web under tension from the roll 50 and draw the web through and/or across the various devices 58, 60 and 62. The web is thereafter intermittently advanced by nip rollers 75 through idler rollers 66, a dancer roller 68 accumulating portions of the web being fed continuously by the roller 64 when the rollers 75 are halted, additional idler rollers 70, a longitudinal hem sealer 72 and U-wrap rollers 74. The rollers 75 feed bag width portions of the web to a transverse heat sealing and cutting apparatus 78 formed by a combination cutter/-sealer 76 cooperating with a roller 77. The apparatus 78 separates and seals the side edges of individual bag bodies B from the continuous web. The bag bodies may be taken from the apparatus 78 and folded by conventional means (not depicted), if desired. The method of forming a draw tape bag by the steps performed by the depicted arrangement of devices is the subject of a related co-pending application Ser. No. 652,254, filed Sept. 20, 1984, assigned to the assignee of this application and incorporated by reference herein. The idler roller 56, hem forming apparatus 58, punch 60 and tape inserter 62 are all supported on a stationary frame 80, having a horizontal member 82, vertical members 84, 86 and 88 and identical members hidden behind the members depicted in FIG. 1.

Figure 2:
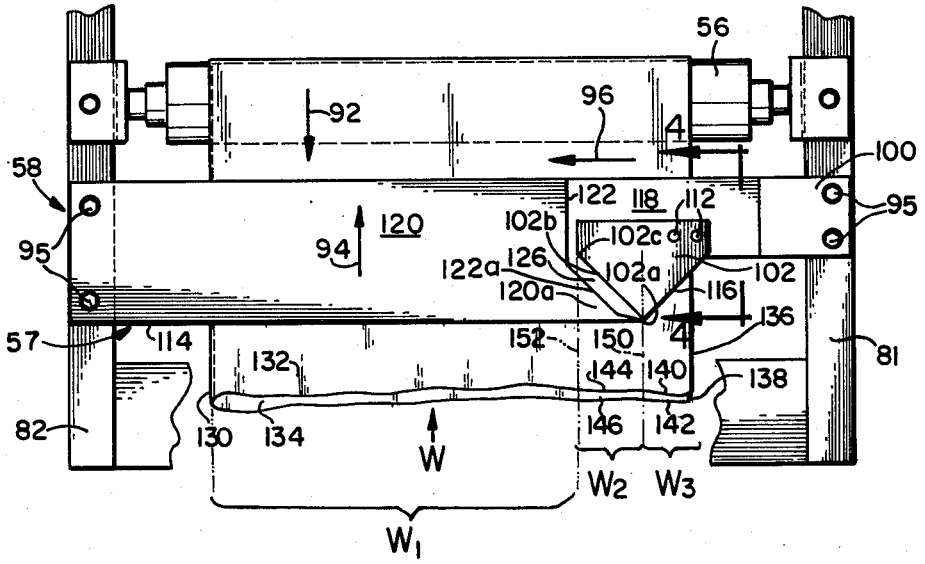
FIG. 2 is plan view of the preferred embodiment former of the subject invention.

Refer now to FIG. 2, a plan view of a preferred embodiment of the apparatus 58. The apparatus 58 is formed by a plate 100 mounting a triangular turning assembly 102 on one side thereof and mounted by suitable means such as nuts (not depicted) and bolts 95 on either side to horizontal members 82 and 81 of the frame 80. The web W is fed over the idler roller 56, conventionally mounted to the members of the frame 80, in a feed direction indicated by the arrow 92 beneath the plate 100, around the forward edge 57 of the plate 100 which reverses the web and feeds it in a taken-up direction indicated by the arrow 94 through the punch 60 and tape inserter 62 to the rollers 64 of FIG. 1. The latter maintain the web W under tension while they draw the web W around the edge 57. The edge 57 is formed by a main edge portion 114 of the bar 100 substantially transverse to the feed and take-up directions 92 and 94 of the web and a hemming edge 116 contiguous to and extend from one end of the main turning edge 114. The hemming edge 116 forms with the main edge 114 an included angle of about 135° (i.e., a 45° included angle with an extension of the main edge 114). The turning edge 116 extends from the main edge 114 towards the approaching and retreating directions 92 and 94 of the web W so as to provide slack in the web as will be later described. The edge 57 forms a plane substantially parallel to the top surface 120 of the plate 100 and to a plane formed by the turned web W' in FIG. 1. A recessed portion 118 of the depicted upper surface of the plate 100 is cut adjacent to the hem turning edge 116. A vertical edge or lip 122 marks the juncture of the cut or recessed portion 118 of the upper surface and a remaining, uncut portion 120. A gap 126 is provided between edge **102*b* of the turning assembly 102 and proximal portions of the lip 122. This gap will allow the innermost panel of the web W to pass beneath the assembly 102 in a manner to be later described. A main portion 122*a* of the edge 122 proximal to the edge 102*b* of the turning assembly 102 forms an approximately 45° included angle with the main turning edge 114 and a 90° included angle with the hemming edge 116**.

Figure 3:
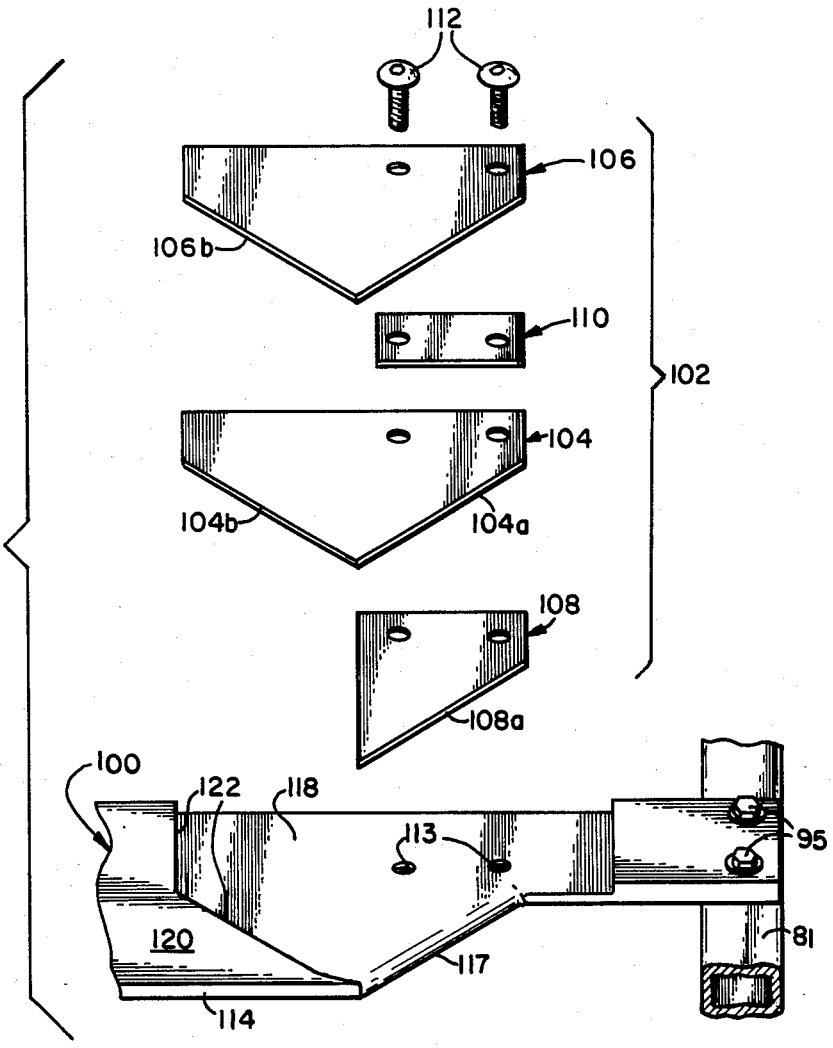
FIG. 3 is an exploded view of the triangular turning assembly portion of the preferred embodiment of FIG. 2.
Figure 4:
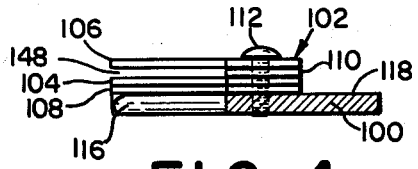
FIG. 4 is a side view of the turning assembly of FIG. 2 between the lines 4—4 and 152.

Mounted to the recessed surface 118 between the edge 116 and lip 122 is the truncated, triangular turning assembly 102, the components of which are broken out in a perspective exploded view in FIG. 3 and include a lower, truncated right isosceles turning triangle 104, an upper, truncated right isosceles turning triangle 106, a lower, truncated, right triangular spacer 108 and a rectangular spacer 110. The components of the assembly 102 are fixed to the upper surface 118 by bolts 112, mounted with suitably threaded bores 113 (see FIG. 3) in the plate 100. As can best be appreciated by viewing FIG. 3, the main turning edge 114 is formed by providing a radius to the leading edge of the uncut portion 120 of the bar 100. Edges **104*a* and 108*a* of the elements 104 and 108 are parallel and superposed with an edge 117 of the cut portion 118 of the bar to form an effectively smooth and continuous turning surface, the hem turning edge 116 of FIG. 2. As is best seen in FIG. 4, the rectangular spacer 110 provides a gap 148 between the upper surface of the lower turning triangle 104 and lower surface of the upper turning triangle 106. As is best appreciated from FIG. 5, the right triangular spacer 108 provides a gap 149 between the cut surface 118 of the bar and lower surface of the lower turning triangle 104**. The need for these gaps will be subsequently explained.

Referring again to FIG. 2, the leading edge of the web W is depicted in a greatly exaggerated view for clarity, as if it were rounding the main edge 114. The web W is formed by a single sheet of material folded along a median longitudinal line to provide a longitudinal fold edge 130, a pair of superposed panels 132 and 134 having free longitudinal edges 136 and 138, respectively, opposite the fold edge 130. The web W and each panel 132 and 134 is conceptually separated into three longitudinal segments by broken lines 150 and 152. Broken line 150 is normal to the leading edge 114 and passes through the junction of the two edges 114 and 116. It is also a projection of the leading tip 102*a* of the turning triangle assembly 102. Broken line 152 represents an extension, normal to the main turning edge 114, of rearward tip 102*c* at the end of the edge 102*b* of the assembly 102. The portion $w_1$ of the web W to the left of the broken line 152 passes beneath the board 100, over the main turning edge 114 and across the uncut portion 120 of the upper surface of the bar 100. The portion $w_2$ of the web W line between the broken lines 150 and 152 passes beneath the lower surface of the bar 100, around the main turning edge 114 proximal to the hemming edge 116 and around the turning assembly 102. In particular, the innermost panel 132 passes through the gaps 126 (see FIG. 2) and 149 (see FIG. 5) while the outermost panel 134 passes over the depicted upper surface of the assembly 102 which is formed by the upper surface of the upper turning triangle 106 (see FIG. 3). The extreme free edge portions $w_3$ of the web W to the right of line 150 also pass beneath the lower surface of the bar 100, over the hemming edge 116 in a direction indicated by the arrow 96, transverse to the fed direction 92 and take-up direction 94 of the web, and into the gap 148 between the elements 104 and 106 (see FIG. 4). The actual hem forming operation is better understood with reference to FIGS. 6 and 7 which depict hem forming for the inner panel 132 and outer panel 134, respectively.

In FIG. 6, the upper turning member 106 and spacer 110 of the assembly 102 have been broken away to expose the gap 148 of FIG. 5 and reveal the upper surface of the lower turning member 104 and hem turning edge 104*b* of that member. The longitudinal edge portion 140 of the inner panel 132 (the $w_3$ portion of that panel in FIG. 2) passes from the idler roller 56, beneath the lower surface of the bar 100, around the hemming edge 116 (formed by the edge 117 of the bar 100, edge 108*a* of the triangular spacer 108 and edge 104*a* of the lower triangular turning member 104, as shown in FIG. 3) into the exposed gap. 148 (see also FIG. 5) between the lower surface of turning member 106 and upper surface of turning member 104. The portion of the web passing through the exposed gap is identified as 140' in FIG. 6 and moves in a direction indicated by arrow 96 substantially transverse to the feed direction 92 and take-up direction 94 of the web. The transversely moving portion 140' is turned over edge 104*b* of the lower turning triangle 104 into the gap 149 of FIG. 5 formed between the lower surface of that member and the upper surface 118 of the plate 100, so as to overlap the adjoining intermediate portion 44 of the panel 132 (i.e., the $w_2$ portion of panel 132 in FIG. 2) so as to form a hem 154. The free edge of the panel 32 is identified as 140'' after it has turned over the edge 104*b*. The plate 104 and, in particular, the 90° included angle of the plate between the edges 116 and 104*b*, subtending the included angle between edges 114 and 116, keeps the material 140' fairly taut and prevents it from slackening.

Figure 7:
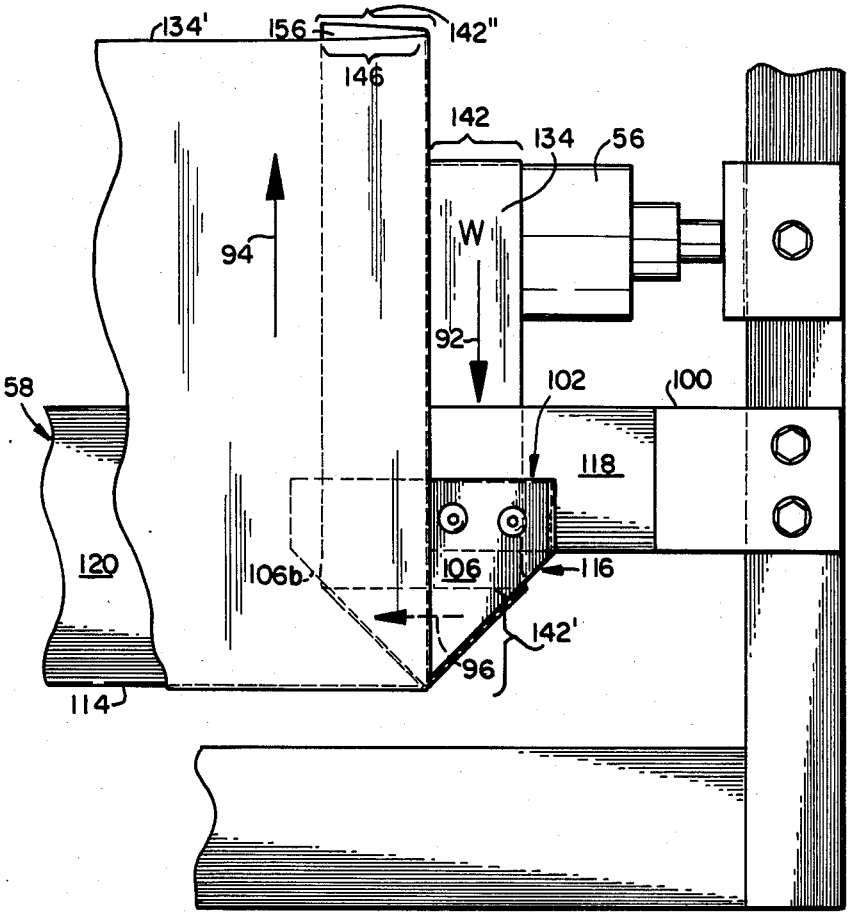
FIG. 7 depicts the hemming of the outer panel of the web.
Figure 8:
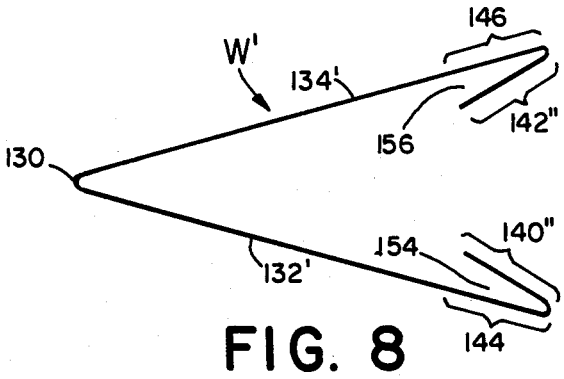
FIG. 8 is a section transverse view of the web along the lines 8—8 of FIG. 1 as it leaves the hemming device of the subject invention in which the panel components are separated from one another for clarity.

As is depicted in FIG. 7, the outer panel 134 is fed from the idler roller 56 longitudinally in the direction indicated by arrow 92 beneath the lower surface of the bar 100 and around the turning edge 114 and hemming edge 116. The portion 142 of this panel (i.e., the portion $w_3$ of the same panel in FIG. 2) is turned over the edge 116 into the gap 148 (see FIG. 5) between the elements 104 and 106 and in a direction indicated by the arrow 96 transverse to the fed direction 92 and take-up direction 94 to the turning edge 106*b* of the upper member 106 (see also FIG. 3). The transversely moving edge portion of the panel 134, now referred to by the numeral 142', is turned over the edge 106*b*, onto the upper surface of the upper member 106 and against the facing intermediate portion 146 of the panel 134 (i.e., portion $w_2$ of the same panel in FIG. 2) so as to form the second hem 156 facing the first hem 154 of the inner panel 132. It will be appreciated from FIGS. 6 and 7 that the edgemost panel portions 140 and 142 of the two panels 132 and 134 are fed in a superposed relation beneath the bar 104 and into the gap 148 and are turned away from one another over the turning edges 104*b* and 106*b*, respectively, and once again lie in superposed relationship and contact with one another upon leaving the assembly 102. The components of the hemmed web, referred to FIG. 1 as W', upon leaving the apparatus 58, are depicted in FIG. 8 in a separated view for clarity showing the superposed inwardly turned hems 154 and 156 formed along the free longitudinal sides of each panel 132' and 134' opposite the fold edge 130.

One skilled in the art will appreciate that for a web substantially reversed in direction by the hemming apparatus of the invention, as is the web W by the depicted preferred embodiment apparatus 58, an approximately 90° included angle must be provided between the hem turning edge 116 of the apparatus and the hemming edges 104*b* and 106*b*, to maintain the web edges under tension while they are are folded. One so skilled will also appreciate that the included angle between the main turning edge 114 and the hemming edge 116 may be adjusted from the suggested value of 135° to a greater or less value that must certainly be greater than 90° and less than 180°. One so skilled in the art will also appreciate that the web W need not be reversed in direction over a leading edge 57 of the apparatus but may be turned some angle less than 180°, and that the included angles between the hemming edge 116 and the turning edges 102*b* and 104*b* of the turning assembly 102 will have to be reduced accordingly.

Although truncated triangular elements 104 and 106 are provided for convenience and compactness in the preferred embodiment, non-truncated elements may be substituted therefor and the edge 122 adjusted accordingly.

While the hemming device of the subject invention is suggestedly and preferably used with a continuously advanced polyfilm web, the apparatus may also be employed in the same manner for an intermittently advanced web.

One skilled in the art will also appreciate that substituting a rectangular spacer such as the spacer 110 or the like for the lower spacer 108 of the turning assembly 102 described, and exchanging the described paths of the portions $w_2$ and $w_3$ of each panel around and through the elements of the panel assembly 102 (i.e., passing the $w_2$ portions between elements 104 and 106, portion $w_3$ of the panel 132 beneath 104 and portion $w_3$ of panel 134 over 106) that the described apparatus can be used to outwardly hem the two panels.

Although a preferred embodiment of the invention has been described and modifications and changes thereto suggested, other modifications of the preferred embodiment will be apparent to one skilled in the art and the subject invention is not limited to the preferred embodiment but is rather described by the following claims.

We claim:

1. A combination comprising:

a continuous web formed of two juxtaposed pliable panels each having a longitudinal free edge along the same one side of the web;

feed means for feeding the continuous web along a feed path;

take-up means spaced from the feed means for taking up the fed juxtaposed panels under tension; and forming means positioned along the feed path downstream from the feed means and upstream from the take-up means for turning the direction of the two juxtaposed panels and simultaneously hemming a longitudinal side edge portion of each panel along the one side and including:

a first turning edge means substantially transverse to a longitudinal feed direction of the juxtaposed layers, having a first end terminating short of the free longitudinal side edges of the juxtaposed panels and a second, opposing end extending transversely beyond the opposing side edge of the web for turning the direction of all but a longitudinal free side edge portion of each of the two layers from said longitudinal fed direction to a taken-up direction;

a second turning edge means extending from said first end of said first turning edge means across and beyond said longitudinal free side edge portion of each panel and across said free edges at an included angle greater than 90° and less than 180° for turning said longitudinal free side edge portions of the panels towards the remaining portion of the web passing over said first turning edge;

third turning edge means extending from the junction of the first turning edge means and second turning edge means to a position overlapping the free side edge portions of the panels turned over said second edge means and overlapping an intermediate poriton of the panels adjoining the side edge portions and turned over said first turning edge means for turning the once-turned longitudinal free side edge portion of one panel against the once-turned intermediate portion of the same panel; and fourth turning edge means substantially parallel to and spaced apart from said third edge means for turning the once-turned longitudinal free side edge portion of the remaining panel against the once-turned intermediate portion of said remaining panel.

2. The combination of claim 1 wherein said first turning edge means substantially reverses the direction of said remaining portion of the web passing over it and the included angle between said second turning edge means and said third and fourth turning edge means is approximately 90°.

3. The combination of claim 2 wherein said second turning edge means forms an included angle of about 135° with said first turning edge means.

4. The combination of claim 1 wherein said first turning edge means and at least a portion of said second turning edge means is provided by adjoining edges of a plate member over which said web is turned and each of said third and fourth turning edges is provided by a separate turning element mounted to and spaced from said plate.

5. The combination of claim 4 wherein at least one of said turning elements has an additional edge forming a portion of said second turning edge of the apparatus.

6. The combination of claim 5 wherein the included angle between said two edges of the one turning element is about 90°.

7. The combination of claim 6 wherein one of said two edges of the one element form an included angle of approximately 45° with the first turning edge means.

8. An apparatus for forming a pair of hems in each of two superposed panels of a longitudinally folded continuous sheet of pliable material comprising:

a main plate;

an edge along one side of the main plate having a first portion and a second portion extending from one end of said first portion and forming an included angle with the first portion greater than 90° and less than 180°;

a major surface of said plate having a recessed portion extending about said one end of the first edge portion partially through said included angle from said second edge portion to a position between a line extending normal to said first edge portion from the junction of the two edge portions and the first edge portion;

a lip separating said recessed portion form a relatively raised, remaining portion of said major surface, part of said remaining portion extending through said included angle between said position and said first edge portion;

a turning structure joined to the main plate within said recessed portion of the major surface between said second edge and said lip and having a first hemming edge spaced from said recessed portion and extending from the junction of said first and second edge portions between said normal line and said first edge portion forming a gap between said first hemming edge and said lip and a gap between said first hemming edge and said recessed portion and a second hemming edge extending from said junction parallel with said first hemming edge and spaced from said first hemming edge and from said lip forming a gap between said second hemming edge and said first hemming edge and a gap between said second hemming edge and said lip.

9. The apparatus of claim 1 wherein said hemming edges form an included angle of approximately 90°, with said second edge portion of the main plate edge.

10. The appparatus of claim 9 wherein said second edge portion of the main plate edge forms an included angle of approximately 135° with said first edge portion of the main plate edge.

11. An apparatus for forming pair of inwardly turned hems in a side edge of each of a pair of superposed panels of pliable material comprising:

first turning edge means for turning at least superposed intermediate longitudinal portions of the superposed panels from a fed direction to a taken-up direction;

second edge means adjoining one side of said first edge means for turning superposed longitudinal edge portions of the panels adjoining said intermediate portions towards the turned, intermediate portions of said panels; and third and fourth edge means extending across said intermediate portions of the panels for turning a separate one of said longitudinal edge portions against the intermediate portion of the same panel forming a hem.

12. The apparatus of claim 11 wherein said third and fourth edge means extend between said intermediate portions of the panels for separating said intermediate portions of the panels and are spaced from one another for passing said side edge portions between the separated intermediate portions.

13. In a method of forming a draw string or draw tape thermoplastic film bag including the steps of turning superposed longitudinal edge portions of a pair of continuous, superposed thermoplastic film panels to form a pair of superposed hems along one longitudinal side of the panels, the improvement comprising the steps of:

turning at least intermediate longitudinal portions of the panels adjoining said longitudinal edge portions of the superposed panels over a first turning edge;

at least partially separating said intermediate longitudinal portions of the pair of panels from one another after passing said first turning edge;

turning said superposed longitudinal edge portions of the panels over a second edge and between the separated intermediate portions; and folding each of said longitudinal edge portions away from one another and against the transversely connected intermediate longitudinal portion of the same panel forming a pair of inwardly turned hems.

14. A method of forming a pair of inwardly turned hems in a pair of superposed continuous panels of pliable material comprising the steps of:

turning intermediate, longitudinal superposed portions of said pair of superposed panels adjoining superposed longitudinal side edge portions of the panels along one side of the panels from a first fed direction to a second taken-up direction;

turning said superposed longitudinal side edge portions of the panels from said first, fed direction to a direction transverse to said taken-up direction towards said turned intermediate portions; and turning each of said free edge portions of each panel against the intermediate portion of the same panel to form a hem.

15. The method of claim 14 further comprising the step of separating said turned, intermediate portions of the panels; wherein said second turning step further comprises turning said side portions between the said separated, intermediate portions of said panels and passing said side edge portions between said intermediate portions; and said last turning step comprises turning the free edge portions of each panel away from one another while turning said free edge portion against the intermediate portion of the same panel.

16. In a combination apparatus for making draw tape or draw string bags from superposed plastic film panels with superposed, turned over edge portions of the panels along the same side of the bag forming tunnel structures containing the string or tape and including means for feeding a continuous plastic film sheet longitudinally folded to provide two superposed panels with adjoining free side edges and means for taking up the superposed panels under tension after hemming, an improved former along the web feed path between said feed means and said take-up means comprising:

a first turning edge means positioned transverse with respect to a side edge portion of the superposed panels along the free edge side of the web for turning all but said side edge portions of the panels from a first direction to a second direction;

a second turning edge means extending from one side of the first edge at an included angle greater than 90° and less than 180° across said superposed side edge portions of the panels for turning said side edge portions of the panels from said first direction to a third direction transversing said second direction; and third and fourth turning edge means extending spaced apart and substantially parallel to one another from an intersection of the first and second edges in a direction between the second and third directions across part of the superposed portions of the panels turned over said first edge means and across the side edge portions of the panels turned over the second edge means, for turning a separate one of the side edge portions against a turned, adjoining portion of the same panel forming a hem.

17. An apparatus for forming a pair of hems in each of two superposed panels of a longitudinally folded continuous sheet of pliable material comprising:

a main plate;

an edge along one side of the main plate having a first portion and a second portion extending from one end of said first portion and forming an included angle with the first portion greater than 90° and less than 180°;

a major surface of said plate having a recessed portion extending about said one end of the first edge portion partially through said included angle from said second edge portion to a position between a line extending normal to said first edge portion from the junction of the two edge portions and the first edge portion;

a lip connecting said recessed portion with a relatively raised, remaining portion of said major surface, part of said remaining portion extending through said included angle between said position and said first edge portion; and a turning structure joined to the main plate within said recessed portion of the major surface between said second edge portion and said lip and including a pair of plate means, each plate means having one edge forming a first hemming edge and a second hemming edge, respectively, first spacer means between said pair of plate means for forming a gap separating said first hemming edge and said second hemming edge from one another and second spacer means between said recessed portion and said pair of plate means for providing a gap between said recessed portion and said first and second hemming edges, said first and second hemming edges each extending from the junction of said first and second edge portions between said normal line and said first edge portion spaced from said lip so as to form a gap between said lip and said first and second hemming edges.

* * * * *